US005695389A

United States Patent [19]

Bartel et al.

[11] Patent Number: 5,695,389

[45] Date of Patent: Dec. 9, 1997

[54] BLASTING DEVICE WITH OSCILLATING NOZZLE

[75] Inventors: J. Christian Bartel, Chagrin Falls; William A. McGee, East Canton; Anthony P. Duracensky, Euclid, all of Ohio

[73] Assignee: Inventive Machine Corporation, Akron, Ohio

[21] Appl. No.: 583,788

[22] Filed: Jan. 11, 1996

[51] Int. Cl.[6] ..... B24C 3/06

[52] U.S. Cl. ..... 451/92; 451/87; 451/350; 451/344; 280/47.36

[58] Field of Search ..... 457/92, 87, 350, 457/344; 15/410; 280/47.36, 47.371, 655.1; 239/102.1, 242, 283

[56] References Cited

U.S. PATENT DOCUMENTS

| | | | |
|---|---|---|---|
| 2,763,492 | 9/1956 | Phelps | 280/47.36 |
| 3,916,568 | 11/1975 | Rose et al. | 451/92 |
| 3,958,652 | 5/1976 | Urakami et al. | 180/145 |
| 4,029,164 | 6/1977 | Urakami | 180/145 |
| 4,095,378 | 6/1978 | Urakami | 51/425 |
| 4,220,284 | 9/1980 | Beiswenger et al. | 239/242 |
| 4,563,840 | 1/1986 | Urakami | 51/410 |
| 4,688,289 | 8/1987 | Urakami | 15/98 |
| 4,809,383 | 3/1989 | Urakami | 15/98 |
| 4,934,475 | 6/1990 | Urakami | 451/92 |
| 5,181,348 | 1/1993 | Roemmele et al. | 451/92 |
| 5,291,697 | 3/1994 | Nelson | 451/92 |
| 5,339,573 | 8/1994 | Uchida et al. | 451/92 |

FOREIGN PATENT DOCUMENTS

| | | | |
|---|---|---|---|
| 401301066 | 12/1989 | Japan | 451/92 |

*Primary Examiner*—Robert A. Rose
*Assistant Examiner*—George Nguyen
*Attorney, Agent, or Firm*—Sand & Sebolt

[57] ABSTRACT

A blasting device for directed air with entrained blast media at a work surface includes a frame supporting a reciprocal valve, and an adjustable valve limit switch. A shaft is attached to the reciprocal valve at one end, and is supported via a bearing assembly at the other end with a blast nozzle mounted thereto. Rotation of the reciprocal valve causes rotation of the interconnected blast nozzle such that air with entrained blast media exiting the blast nozzle travels along a path beneath the frame. The frame is supported on wheels, and is moved along a work surface by an operator. A vacuum port is positioned adjacent the work surface for removing spent blast media with entrained debris from beneath the blasting device. The handle may be rotated from end to end for ease of operation to assure that the user may move the blasting device in either the forward or rearward direction along a work surface.

15 Claims, 7 Drawing Sheets

BLASTING DEVICE WITH OSCILLATING NOZZLE

BACKGROUND OF THE INVENTION

1. Technical Field

The invention relates to particle blasting devices. More particularly, the invention relates to blasting devices which direct blast media at a work surface. Specifically, the invention relates to a blasting device having an oscillating nozzle supported on a rolling frame to prepare a relatively wide strip of the work surface.

2. Background Information

As society continues to expand, so does the need for steel in manufacturing and in industrial, commercial, governmental and domestic construction. Generally, when steel is used in manufacturing and construction, it must be prepared to receive a protective coating such as paint. Additionally, when existing structures, such as bridges, buildings and storage tanks are repainted, the steel and concrete must be cleaned by removing debris, rust, oxidation and existing paint so that a strong bond forms between the new protective coating and the metal and concrete.

While metal and concrete have been cleaned in a variety of ways, with a variety of devices, the most common way to prepare a work surface to receive a protective coating is to blast the area with high pressure air having particles entrained therein. This form of cleaning has become known as "sand blasting". Sand blasting has been so termed, as sand, or silicate was often used as the particle entrained within the air. However, as sand blasting increased in popularity, the use of steel, coal slog, minerals, plastics and resins also increased in popularity as the abrasive material. The particles entrained within the high pressure air contact the work surface, and abrade the surface, removing debris, rust, and even a thin layer of metal to assure that the work surface is clean and dry to accept a protective coating. Additionally, the surface is roughened to provide an increased surface area onto which the protective coating may adhere.

While open sand blasting operates to prepare metal and concrete for paint application, the process is relatively time consuming and expensive. Open sand blasting is messy, costly and may be hazardous to the blasting operator. Additionally, the blast nozzles are normally in the range of from ⅛ to ¾ inches and are attached directly to an air delivery hose while the operator moves the blast nozzle over the work surface to remove material along a strip in the range of from 2 to 4 inches wide. While this method of sand blasting is presumably adequate for the purpose for which it is intended, it is time consuming and costly to blast larger structures such as buildings, bridges and steel tanks. Inasmuch as open sand blasting involves the projection of air entrained particulate at a structure, and the particulate falls under the effect of gravity, the entire structure to be sand blasted must be draped to prevent contamination of the surrounding environment with heavy metals, such as leads and zincs in the protective coatings. Additionally, the operator must be positioned adjacent the area to be sand blasted, thereby substantially increasing the cost associated with surface preparation as scaffolding must be constructed around the perimeter of the structure to support the user adjacent the area to be prepared.

An additonal problem associated with traditional open sand blasting is that the operator must be positioned adjacent the blast area which substantially increases the operator's health risks. When the operator is positioned adjacent the blast area, the operator is subject to a variety of risks including damage to the respiratory system. Particles often shatter upon impinging the work surface thereby creating a significant amount of dust and debris entrained in the ambient atmosphere, which dust is likely to be ingested by the operator. Additionally, paints and debris removed from the work surface are often heavy metal based. These paints also become air born when removed from the work surface thereby substantially increasing the operator's risk to respiratory ailments which may be caused by long term exposure to heavy metal and heavy metal based products, including paints and enamels.

Vacuum assisted sand blasting was developed to alleviate a number of the problems associated with open sand blasting. Specifically, vacuum assisted sand blasting substantially reduces the risk to the operator by removing a significant amount of air entrained particles thereby reducing the risk to the operator's respiratory system. While vacuum assisted sand blasting is presumably adequate for the purpose for which it is intended, previous system have been relatively complicated, and are not particularly reliable. Additionally, the pattern cleaned by a typical vacuum assisted sand blaster is in the range of from only 3 to 4 inches.

A number of devices have been developed which allow an operator to sand blast a larger area within a given time frame, and which position the operator some distance away from the blasting operation. Specifically, a number of patents to Urakami, including U.S. Pat. Nos. 4,095,378 and 4,688,289 have been developed to position the blast nozzle away from the user, and which provide a nozzle which prepares large work surfaces for paint application. These devices generally provide suction adherence to a wall surface and a method of moving the work head along the work surface to remove rust and debris therefrom. While these devices are presumably adequate for the purpose for which they are intended, the use of suction can be complicated and difficult to utilize when the device is used on an uneven work surface such as a road surface or lapped steel plate.

An additional expense associated with blast cleaning metal and concrete is that the blast media can be relatively expensive. It has thus become common to collect blast media, filter out pulverized blast media and entrained particulates such as paint and debris, and reuse the remaining media for additional sand blasting operations. While the collection and reuse of spent blast media is somewhat expensive, it still remains more economical than purchasing additional blast media for all sand blasting operations. The cost savings associated with the collection and reuse of spent blast media is significant when one considers that blast media with entrained heavy metal particles, such as paint, is considered hazardous waste, substantially increasing disposal costs.

Therefore, the need exists for an improved blasting device which increases the surface area prepared in a given time period, positions the user away from the immediate sand blasting operation, and which effectively collects spent blast media for reuse.

SUMMARY OF THE INVENTION

Objectives of the invention include providing a blasting device which quickly cleans a work surface.

Another objective is to provide a blasting device which has an oscillating nozzle.

A further objective is to provide a blasting device whereby the path of the oscillating nozzle is adjustable.

A still further objective is to provide a blasting device which positions the user away from the blasting operation.

Yet another objective is to provide a blasting device which may be conveniently rolled along a work surface at a speed chosen by the operator.

Another objective is to provide a blasting device which may be easily moved in either a forward or a rearward direction.

Yet another objective is to provide a blasting device which reclaims spent blast media from adjacent the blasting operation.

Yet a further objective is to provide a blasting device which will accept a variety of blast nozzles.

Another objective is to provide a blasting device which evenly directs blast media at the work surface.

A still further objective is to provide such a blasting device which is of simple construction, which achieves the stated objectives in a simple, effective and inexpensive manner, and which solves problems and satisfies needs existing in the art.

These and other objectives and advantages of the invention are obtained by the improved blasting device for repairing a work surface, the general nature of which may be stated as including a frame having a pair of end walls; a plurality of wheels supporting the frame defining a path of travel; inlet means for receiving air entrained blast media; a blast nozzle operatively connected with the inlet means and carried by the frame; and a handle attached to the frame.

BRIEF DESCRIPTION OF THE DRAWINGS

A preferred embodiment of the invention, illustrative of the best mode in which applicants have contemplated applying the principles, is set forth in the particularly and distinctly pointed out and set forth in the following description and is shown in the drawings and is appended claims.

Similar numerals refer to similar parts throughout the drawings.

DESCRIPTION OF THE PREFERRED EMBODIMENT

Figure 1:
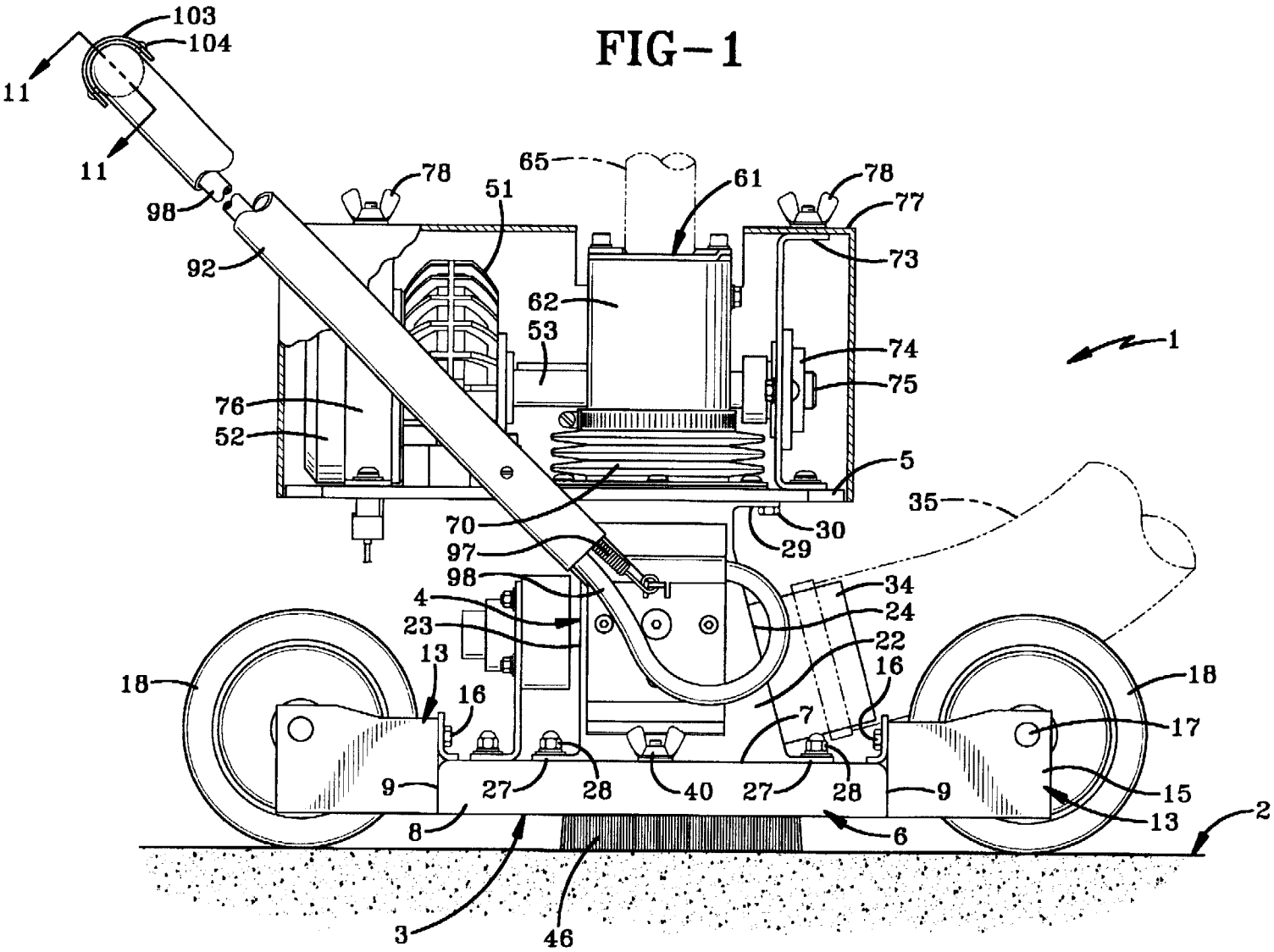
FIG. 1 is a side elevational view of the blasting device of the present ivention with portions cut away and in section, and with the vacuum hose shown in dot-dash lines.

The improved blasting device of the present invention as indicated generally at 1, and is particularly shown in FIG. 1 supported from a work surface 2, such as a steel beam or concrete slab. Blasting device 1 is formed with a lower frame 3, a central frame 4 mounted to lower frame 3, and an upper plate 5.

Figure 3:
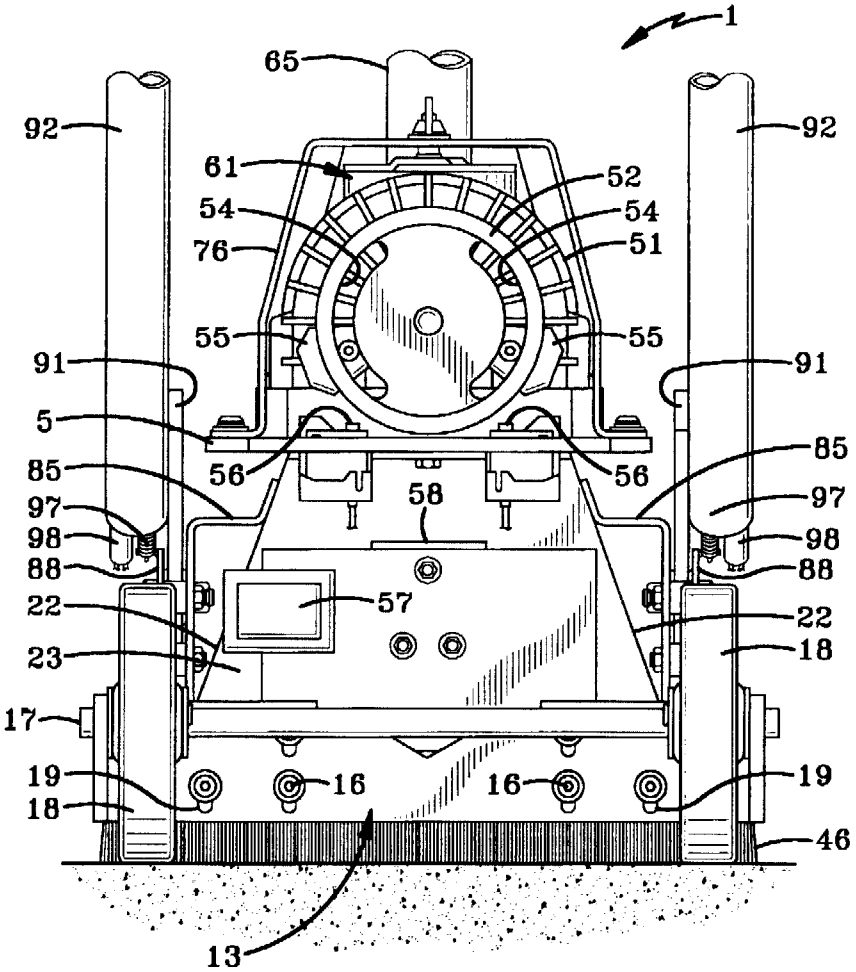
FIG. 3 is an opposite end elevation view of the blasting device shown in FIG. 1 with the handle cut away.
Figure 2:
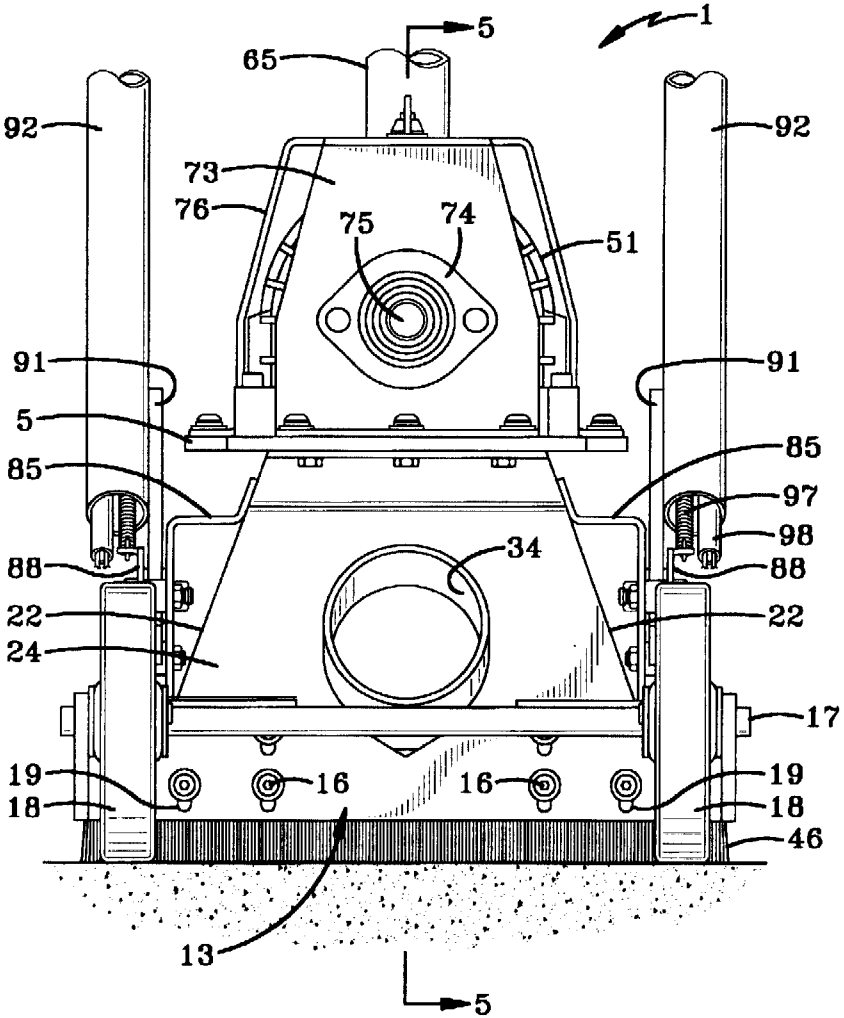
FIG. 2 is an end elevation view of the blasting device shown in FIG. 1 with the handle cut away.
Figure 4:
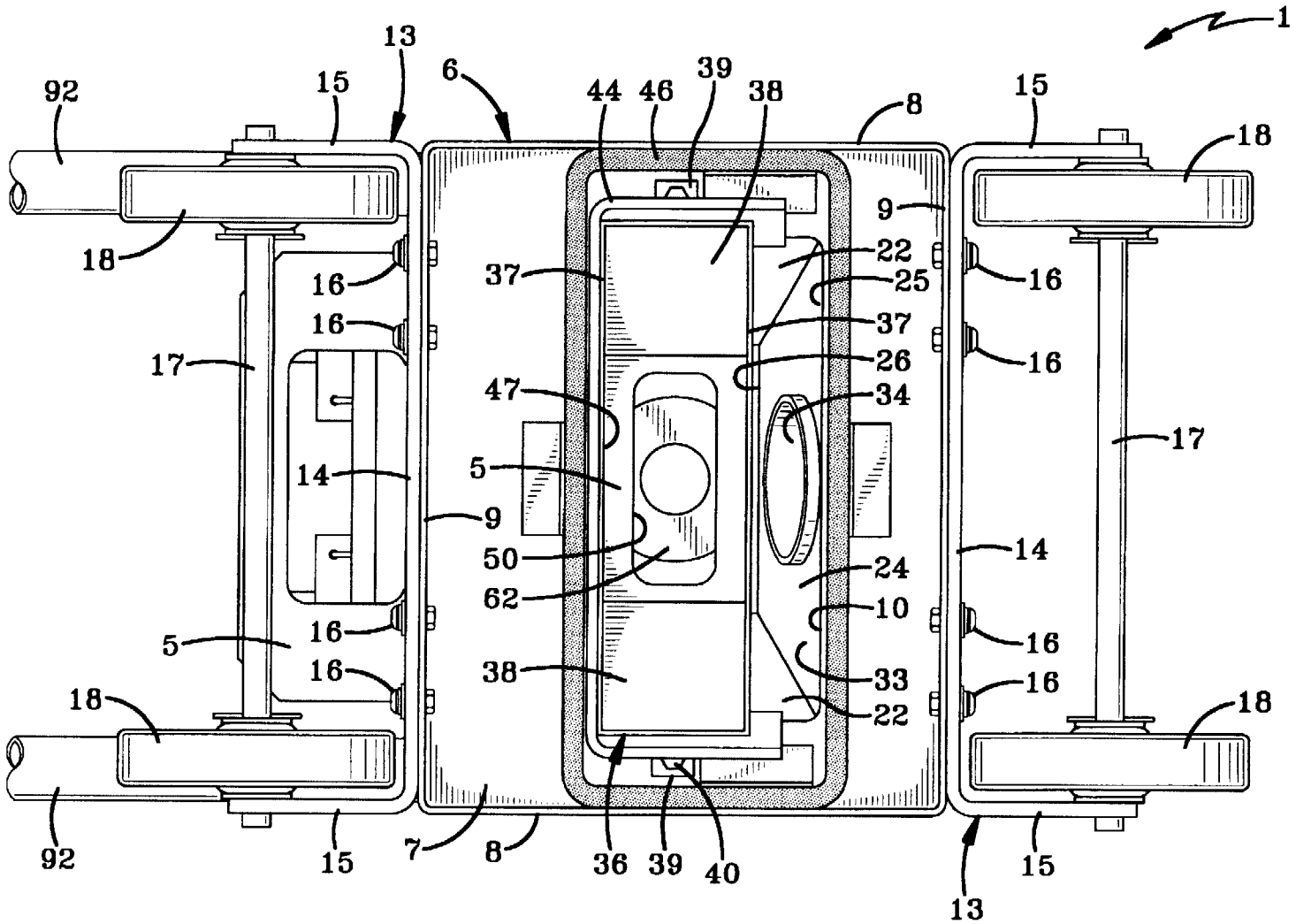
FIG. 4 is a bottom view of the blasting device shown in FIG. 1 with the handle cut away.
Figure 5:
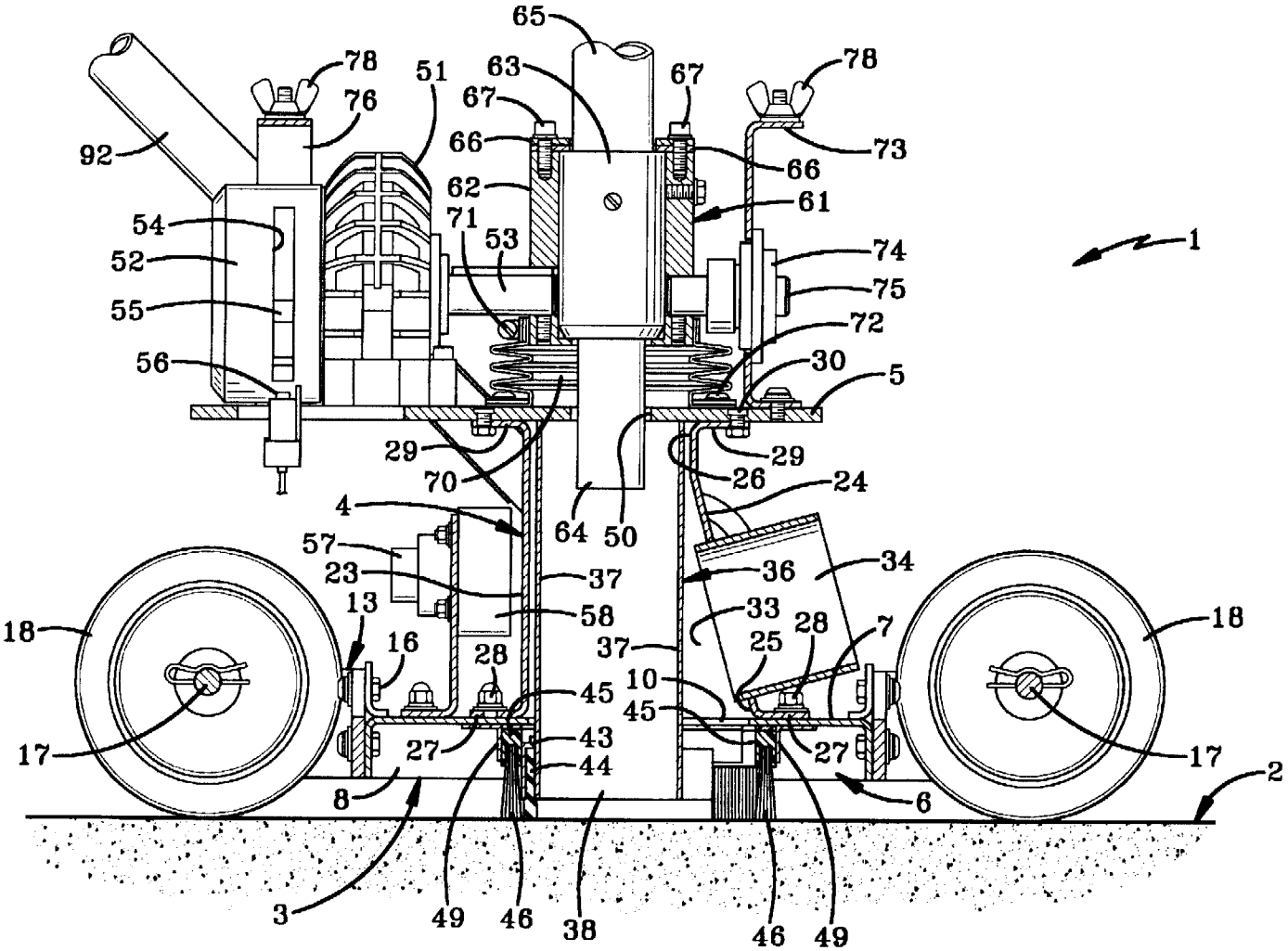
FIG. 5 is a sectional view taken along line 5—5, FIG. 2.

Lower frame 3 is formed with a base 6 having a top wall 7, a pair of parallel and spaced apart sidewalls 8, and a pair of parallel and spaced apart end walls 9 perpendicular to sidewalls 8. Sidewalls 8 and end walls 9 extend downwardly from top wall 7 of base 6. Additionally, top wall 7 is formed with a rectangular opening 10 (FIGS. 4–5). A U-shaped axle bracket 13 is mounted to each end wall 9 of base 6. Each U-shaped axle bracket 13 is formed with a stretcher bar 14, and a pair of parallel and spaced apart outwardly extending legs 15 (FIG. 4). A plurality of fasteners 16 extend through stretcher bar 14 and in each end wall 9 to secure axle bracket 13 to base 6. Each leg 15 of axle bracket 13 is formed with a hole for receiving an axle 17 having a plurality of wheels 18 rotatably mounted thereon. Wheels 18 are thus parallel and spaced apart, with one wheel 18 being mounted at each corner of lower frame 3. Additionally, stretcher bar 14 is formed with a plurality of slots 19 (FIG. 3) whereby one fastener 16 extends into each slot 19 to mount axle bracket 13 to base 6. Axle bracket 13 may thus be moved relative to base 6 to adjust the height of wheels 18 relative to base 6.

Central frame 4 is formed with a pair of spaced apart sidewalls 22, a vertical end wall 23 and an inclined end wall 24 spaced from vertical end wall 23. Sidewalls 22, vertical end wall 23 and inclined end wall 24 form a bottom opening 25 and a top opening 26 (FIGS. 4 and 5). Sidewalls 22 are tapered outwardly (FIG. 6) from top opening 26 toward bottom opening 25 such that bottom opening 25 is larger than top opening 26 for purposes which will be described in detail below. A mounting flange 27 extends outwardly from vertical end wall 23 and inclined end wall 24 adjacent bottom opening 25. Mounting flanges 27 (FIG. 5) receive a plurality of fasteners 28 to mount central frame 4 to top wall 7 of lower frame 3. Similarly, vertical end wall 23 and inclined end wall 24 are each formed with a mounting flange 29 adjacent top opening 26. Fasteners 30 extend through mounting flanges 29 to secure upper plate 5 to central frame 4 adjacent top epening 26. As is apparent from a review of FIGS. 1–5, central frame 4 is mounted to top wall 7 of lower frame 3 with bottom opening 25 in operative communication with opening 10 formed in top wall 7 of lower frame 3.

Figure 6:
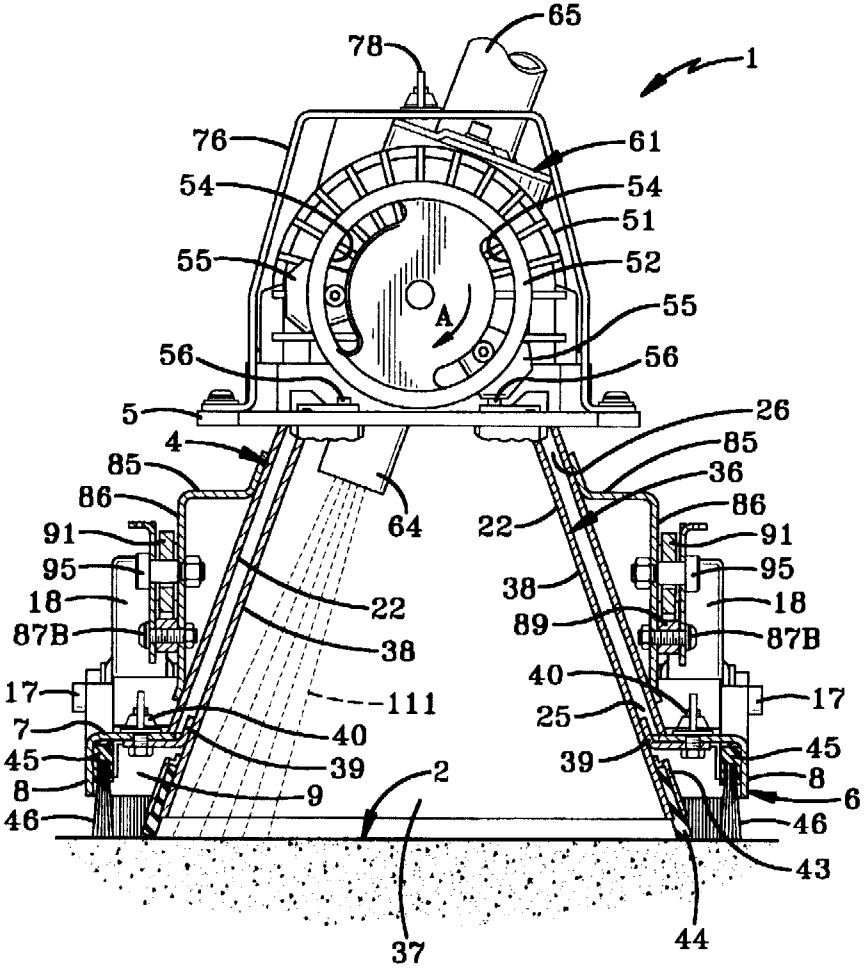
FIG. 6 is an end elevational view similar to FIG. 3, with portions broken away and in section showing the oscillating nozzle in the first position.

In accordance with one of the main features of the invention, sidewalls 22, vertical end wall 23 and inclined end wall 24 are integrally formed and define a vacuum chamber 33. Inclined end wall 24 is formed with a vacuum port 34 sized to receive a vacuum hose 35 (FIG. 1) thereover. Referring specifically to FIGS. 4–6, an inner wear shield 36 is positioned within vacuum chamber 33. Wear shield 36 is formed with a pair of parallel and spaced apart end walls 37, and a pair of sidewalls 38. Each sidewall 38 is parallel with a sidewall 22 of central frame 4 with sidewalls 38 thus being tapered outwardly from top opening 26 toward bottom opening 25. Referring specifically to FIG. 6, a plurality of mounting flanges 39 extend outwardly from sidewalls 38 to receive fasteners 40 thereby securing wear shield 36 within vacuum chamber 33.

End walls 37 and sidewalls 38 are formed with a clip 43 adjacent bottom opening 25 which receives an elastomeric wear bar 44. Similarly, sidewalls 8 of lower frame 3 and a pair of flanges 49, are formed with a clip 45 to receive brush pile 46 which extends circumferentially around bottom opening 25. Wear shield 36 thus protects the interior of vacuum chamber 33, and extends in front of vacuum port 34 for purposes which will be described in detail below. End walls 37 and sidewalls 38 of wear shield 36 are formed with a hole 47. Hole 47 operatively communicates with an elongated slot 50 formed in upper plate 5 (FIG. 4).

Figure 7:
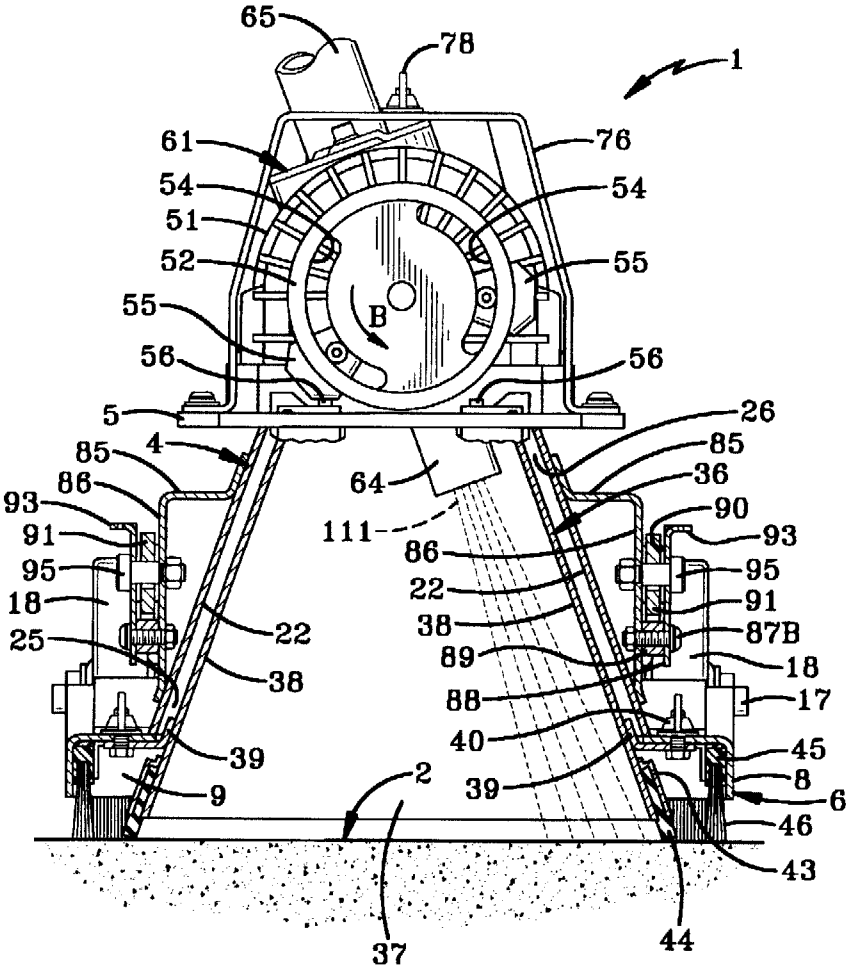
FIG. 7 is an end elevational view similar to FIGS. 3 and 6, with portions broken away and in section showing the oscillatin nozzle in the second position.

In accordance with the invention, a reciprocal valve 51 such as is available from Festo Corporation of Hauppauge, N.Y. as Model No. DSR 40-18 cp is mounted to upper plate 5. A valve limit switch 52 is mounted to one side of reciprocal valve 51 and a shaft 53 is mounted to the other side of reciprocal valve 51. Referring to FIGS. 5–7, valve limit switch 52 is operatively connected to reciprocal valve 51 and operates to change the direction of rotation of reciprocal valve 51. In the preferred embodiment, valve limit switch 52 is adjustable. Specifically, valve limit switch 52 is formed with a pair of mounting slides 54 whereby an actuator pin 55 is mounted within each mounting slide 54. Actuator pins 55 are thus movably mounted within mounting slides 54 and may be slidably positioned therein. Additionally, actuator pins 55 extend outwardly from valve limit switch 52 for purposes which will be described in detail below. One contact button 56 is mounted to upper plate 5 on either side of valve limit switch 52 such that rotation of reciprocal valve 51 will bring each actuator pin 55 into and out of contact with contact buttons 56. Each contact button 56 communicates with logic valve 57 (FIG. 5) and hydraulic logic circuit 58 which communicates with reciprocal valve 51 to alter the direction of rotation of reciprocal valve 51 from clockwise to counterclockwise.

One end of shaft 53 is securely mounted to hydraulic valve 51 such that rotation of hydraulic valve 51 causes shaft 53 to rotate. Another end of valve 53 is securely mounted to a blast head 61. Blast head 61 (FIG. 5) is formed with a body 62 and a nozzle chamber 63 mounted within body 62. A blast nozzle 64 extends downwardly from nozzle chamber 63 through top opening 26 and elongated slot 50 into hole 47 of wear shield 36. Blast nozzle 64 may take a variety of sizes and configurations without departing from the spirit of the present invention. Delivery hose 65 mounts to the top of blast head 61 in operative communication with nozzle chamber 63. Delivery hose 65 is mounted to blast head 61 via a pair of semi-circular mounting rings 66 attached to blast head 61 via fasteners 67. An elastomeric ribbed baffle 70 extends circumferentially around blast nozzle 64 and is mounted intermediate upper plate 5 and blast head 61. Baffle 70 is mounted to blast head 61 via pipe clamp 71 and to upper plate 5 via fasteners 72.

Referring still to FIG. 5, a U-shaped support bracket 73 extends upwardly from upper plate 5 and has a bearing assembly 74 mounted thereto. One end of a shaft 75 is mounted within bearing assembly 74 and is supported by U-shaped bracket 73 while the other end is mounted to blast head 61. Shafts 75 and 53 are axially aligned and operate as a single shaft rotatably supported between bearing assembly 74 and reciprocal valve 51 with blast head 61 mounted thereto. Referring to FIG. 1, a support bracket 76 is mounted over valve limit switch 52 whereby support bracket 76 and U-shaped bracket 73 retain a protective cover 77 via wing nut 78.

Figure 8:
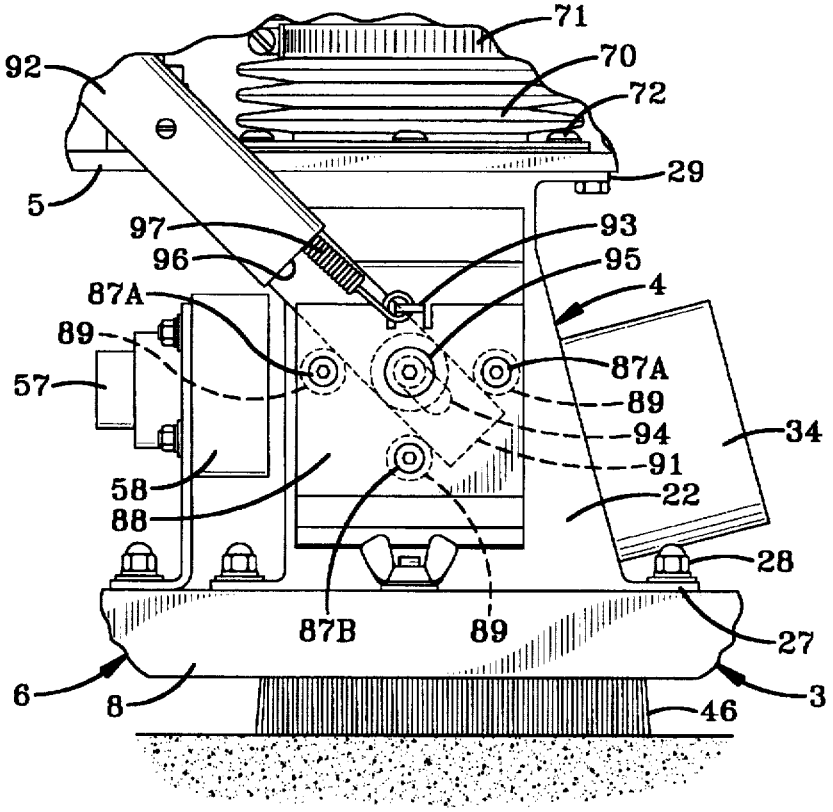
FIG. 8 is an enlarged side elevational view of the blasting device with portions cut away and with the handle shown in a first position.

A weld bracket 85 having a vertical side 86 is welded to each sidewall 22 of center frame 4. Referring to FIGS. 7–8, vertical side 86 of each weld bracket 85 is formed with three holes, each sized to receive one of a plurality of bolts 87A and 87B. An outer plate 88 is parallel to and spaced apart from vertical sides 86 and is mounted to vertical sides 86 with bolts 87A and 87B. A spacer 89 is positioned over each bolt 87 intermediate vertical side 86 and outer plate 88 to assure that vertical sides 86 remains spaced apart from outer plates 88 when bolts 87 are tightened. Each vertical side 86 and each outer plate 88 thus forms a channel 90 therebetween which is sized to receive an end portion 91 of a handle 92. Outer plate 88 is formed with a mounting tab 93.

Each end portion 91 of handle 92 is formed with an elongated slot 94 such that a bolt 95 extends through outer plate 88, slot 94 and vertical side 86. Handle 92 is a U-shaped hollow tube having a pair of opened ends 96 for receiving end portions 91. An expansion spring extends into open ends 96 of handle 92 and is attached to mounting tab 93 such that spring 97 applies a constant force on handle 92.

In accordance with the invention, bolts 87 are spaced in a triangle such that there are two upper bolts 87*a* and one lower bolt 87*b*. Each bolt 87A is spaced from bolt 87B a distance equal to the thickness of end portion 91 of handle 92 such that the same may be received therebetween as shown more specifically in FIGS. 7 and 8. Handle 92 is mounted intermediate outer plate 88 and weld bracket 85 through the interconnection between bolt 95 and slot 94. Inasmuch as slot 94 is elongated relative to bolt 95, the force offered by spring 97 causes end portion 91 to be positioned intermediate bolts 87*b* and 87*a* until bolt 95 contacts the end of elongated slot 94. In this position, end portion 91 of handle 92 will rest against the other bolt 87*a*. As shown in FIG. 1, a wire harness 98 extends through handle 92 and out of each open end 96.

Figure 11:
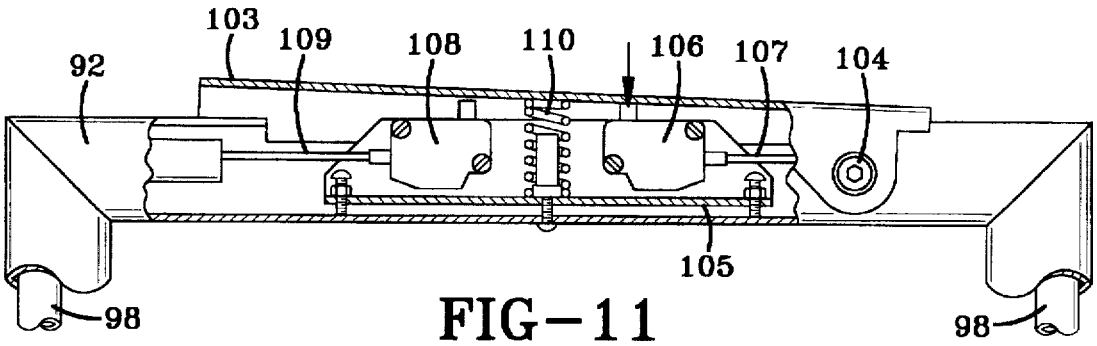
FIG. 11 is a sectional view taken along lines 11—11, FIG. 1 with the trigger in a first position.
Figure 12:
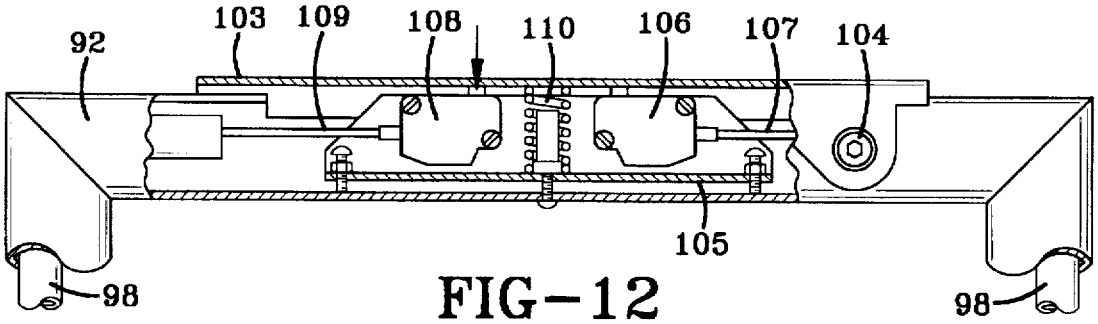
FIG. 12 is a sectional view similar to FIG. 11 shown with the trigger in a second position.

Referring to FIG. 11, a trigger 103 is pivotally mounted to handle 92 via pivot pin 104. A switch bracket 105 is mounted within handle 92 below trigger 103. A first switch 106 is mounted to switch bracket 105, and is connected to reciprocal valve 51 via a wire 107. Similarly, a second switch 108 is mounted to switch bracket 105 and is connected to a pump (not shown) via a wire 109. The pump connected to switch 108 controls the delivery of air with entrained blast media through delivery hose 65. A compression spring 110 is mounted to switch bracket 105 intermediate switches 106 and 108 and applies an upward force to trigger 103. As is apparent from a review of FIG. 11, when trigger 103 is depressed to overcome the force of spring 110, the first switch 106 is depressed prior to second switch 108 as is shown more specifically in FIG. 12.

In operation, blasting device 1 is supported on wheels 18 such that device 1 may be rolled along work surface 2. Specifically, when the operator grasps handle 92 and depresses trigger 103, first switch 106 is actuated causing reciprocal valve 51 to operate. As reciprocal valve rotates in the direction of arrow A shown in FIG. 6, shaft 53 and interconnected blast head 61 and blast nozzle 64 are also rotated therewith. As trigger 103 becomes fully depressed, second switch 108 is actuated which engages the pump causing air with entrained blast media to travel throughdelivery hose 65 into nozzle chamber 63 and ultimately out of blast nozzle 64. Blast media is shown generally at 111 in FIG. 6 and is indicated with dot-dash lines. Note that first switch 106 is actuated before second switch 108. Such sequential operation is included in the present invention to assure that reciprocal valve is operating before air with entrained blast media contacts work surface 2. In this manner, the user is assured that blast media will not be directed at a single location which may remove to much material from the work surface.

As reciprocal valve 51 rotates, actuator pin 55 of valve limit switch 52 will strike contact button 56 as shown particularly in FIG. 6. Such contact will cause hydraulic logic circuit 58 to change the direction of rotation of reciprocal valve 51 such that reciprocal valve 51 rotates in the direction indicated at arrow B in FIG. 7. Specifically, hydraulic logic circuit 58 operates hydraulic valve 57, to change the direction of rotation of reciprocal valve 51 from rotating in the direction of arrow A shown in FIG. 6 to rotating in the direction of arrow B in FIG. 7. The direction of rotation of shaft 53 and interconnected blast nozzle 64 also changes such that blast nozzle 64 and consequentially air with entrained blast media 111 travels a path in the direction transverse to the path of travel of blasting device 1. Reciprocal valve 51 will rotate until the other actuator pin 51 strikes the associated contact button 56 as shown particularly in FIG. 7 and once again, hydraulic circuit 58 will change the direction of rotation of reciprocal valve 51 to that depicted by arrow A in FIG. 6. As each actuator pin 55 strikes the associated contact button 56, reciprocal valve 51 will continue to change its direction of rotation reciprocating between the positions shown in FIG. 6 and FIG. 7 such that blast nozzle 64 continues to move from side to side sweeping out of path in a direction transverse to the direction of movement of blasting device 1.

Additionally, actuator pins 55 may be moved within associated mounting slides 64 to increase or decrease the angle of rotation of reciprocal valve 51. Particularly, if actuating pins 55 are moved toward upper plate 5, they will strike contact buttons 56 more often creating a smaller angle of rotation for reciprocal valve 51. Conversely, if actuator pins 55 are moved within mounting slides 54 away from upper plate 5, reciprocal valve 51 will rotate through a larger arc before striking contact button 56 thereby permitting reciprocal valve 51 to rotate through a larger arc and consequentially assuring that the air with entrained blast media exiting blast nozzle 64 also sweeps out a larger path along work surface 2. The operator will push blasting device 1 at a preselected speed such that air with entrained blast media 111 adequately prepares work surface 2. If work surface 2 requires significant sand blasting, than the user will push blasting device 1 at a slower rate of speed. However, if work surface 2 requires light sand blasting, the operator will push sanding device 1 more quickly.

Figure 9:
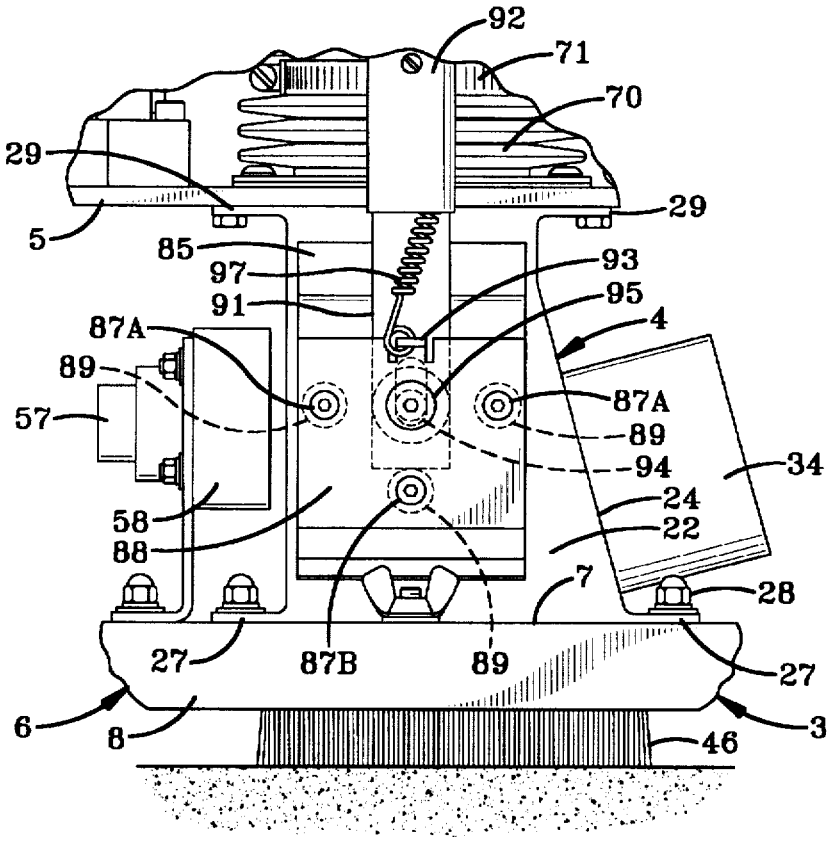
FIG. 9 is an enlarged side elevational view similar to FIG. 8 with the handle shown in a second position.
Figure 10:
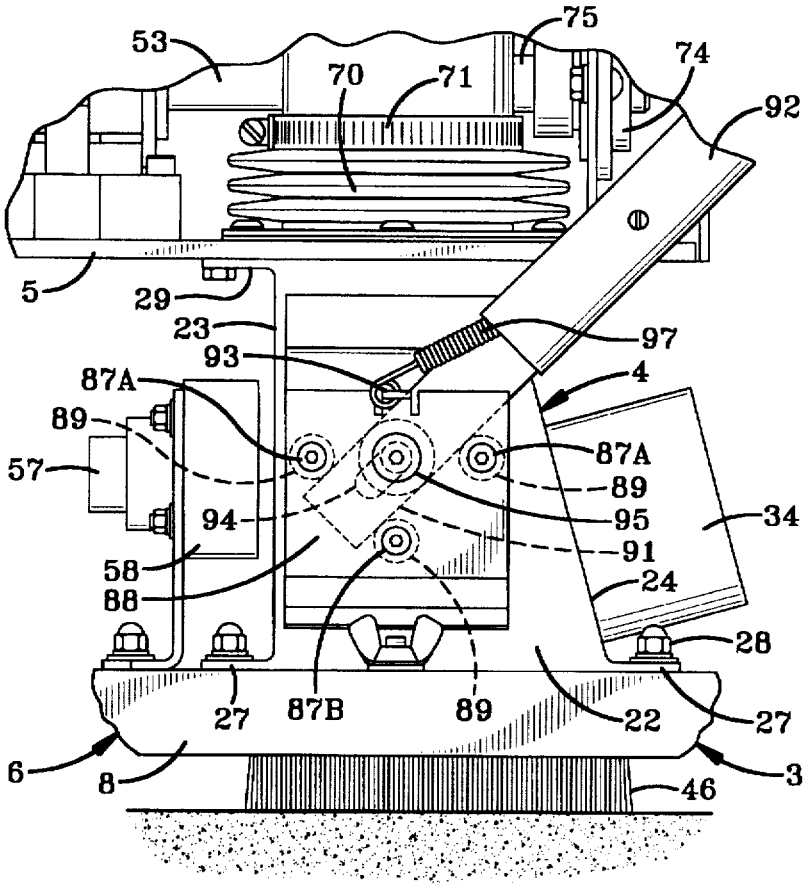
FIG. 10 is an enlarged side elevational view similar to FIGS. 8 and 9 with the handle shown in a third position.

Upon reaching the end of work surface 2, the operator may apply an upward force on handle 92 thereby overcoming the force exerted by spring 97 such that bolt 95 slides within slot 94 and end portion 91 is removed from between bolts **87*a* and 87*b*. Once in this position, handle 92 may be rotated to the position shown in FIG. 9 where end portion 91 is resting on bolt 87*b*. Thereafter, the user may continue to rotate the handle to the position shown in FIG. 10 where spring 97 draws handle 92 and attached end portion 93 intermediate bolt 87*b* and the other bolt 87*a* such that the operator may now actuate trigger 103 and operate blasting device 1 in the opposite direction. As is apparent from a review of FIGS. 8–10, handle 92 may thus be positioned over either end of blasting device 1 such that, upon reaching the end of work surface 2, the operator is not required to turn blasting device around, but will merely rotate handle 92 to the opposite end of blasting device 1 and continue sand blasting work surface 2**.

When the operator has depressed trigger 103 and actuated first switch 106 and second switch 108, air entrained blast media will be directed at work surface 2. Similarly, vacuum pressure is applied for vacuum port 34 which is sufficient to create a vacuum force extending substantially around wear shield 36. Once air with entrained blast media 111 exits blast nozzle 64, the spent blast media with entrained debris such as paint, rust and heavy metals, retained adjacent the blasting area via wear bar 44 and brush pile 46 is removed with vacuum pressure through vacuum port 34. Wear bar 44 and brush pile 46 thus assure that the work area remains clean and relatively free of dust and debris, and particularly, the work area remains free of debris which may be hazardous to the operator's respiratory system. Inasmuch as the spent blast media with entrained debris is retained in a localized manner, and inasmuch as the operator is pushing blasting device 1 at a relatively slow rate of speed, vacuum pressure passing through vacuum port 34 is sufficient to vacuum the spent blast media with entrained debris such that the same may be moved to a discrete location for cleaning and separation whereby the remaining spent blast media may be reused.

As is also apparent from a review of FIG. 5, wear shield 36 will be abraded with blast media and is therefore replaceable. Additionally, wear bar 44 and brush pile 46 may also be replaced as required.

As wear bar 44 and brush pile 46 become used, lower frame 3 may be lowered by loosening fasteners 16 and moving lower frame 3 closer to work surface 2 relative to axle bracket 13. Particularly, when fasteners 16 are loosened, lower frame 3 will move relative to axle brackets 13 as fasteners 16 will move within slots 19. Once lower frame 3 has been repositioned relative to axle brackets 13, fasteners 16 may be retightened within slots 19.

Accordingly, the improved blasting device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved blasting device is constructed and used, the characteristics of the construction, and the advantageous, new and useful results obtained; the new and useful structures, devices, elements, arrangements, parts and combinations, are set forth in the appended claims.

We claim:

1. A blasting device for directing air entrained blast media at a work surface, the blasting device comprising:

a frame having a pair of end walls;

a plurality of wheels supporting the frame defining a path of travel;

inlet means for receiving air entrained blast media;

a blast nozzle operatively connected with the inlet means and carried by the frame;

a handle attached to the frame;

a reciprocal valve attach to the blast nozzle whereby the valve alternatively rotates the blast nozzle in a clockwise direction and a counterclockwise direction;

a blast chamber carried by the frame; whereby the blast nozzle operatively communicates with the blast chamber;

a vacuum chamber in operative communication with the blast chamber;

a vacuum port adapted for receiving a vacuum hose in operative communication with the vacuum chamber; and the vacuum chamber extending at least partially around the blast chamber; and.

2. The blasting device as defined in claim 1 in which the frame is formed with a pair of end walls, and a pair of sidewalls; in which the blast nozzle is mounted intermediate the sidewalls, and oscillates substantially perpendicular to the path of travel.

3. The blasting device as defined in claim 2 in which the reciprocal valve is formed with switch means for changing the direction of rotation of the shaft.

4. The blasting device as defined in claim 3 in which the switch means includes a pair of actuator pins and a pair of contact buttons; in which one actuator pin contacts one contact button when the shaft is rotating clockwise; and in which the other actuator pin contacts the other contact button when the shaft is rotating counterclockwise whereby contact between an actuator pin and contact button causes the reciprocal valve to change the direction of rotation of the shaft.

5. The blasting device as defined in claim 4 in which the reciprocal valve is formed with a pair of mounting slides; and in which each actuator pin is mounted in a respective mounting slide whereby the actuator pin may be moved within the mounting slide to alter the degree of rotation of the shaft.

6. The blasting device as defined in claim 1 in which the blast chamber is formed with a top wall, a pair of sidewalls and an open bottom wall; and in which the nozzle extends into the blast chamber through the top wall.

7. The blasting device as defined in claim 6 in which the blast chamber sidewalls are tapered outwardly from the top wall toward the open bottom wall.

8. The blasting device as defined in claim 1 in which the vacuum means is a vacuum chamber in operative communication with the blast chamber and a vacuumport adapted for receiving a vacuum hose in operative communication with the vacuum chamber.

9. The blasting device as defined in claim 8 in which the vacuum chamber extends at least partially around the blast chamber; in which a plate extends in front of the vacuum port, whereby the plate directs vacuum pressure toward the open bottom wall of the blast chamber.

10. The blasting device as defined in claim 8 in which a wear shield extends at least partially around the open bottom wall of the blast chamber.

11. The blasting device as defined in claim 8 in which a brush pile extends at least partially around the open bottom wall of the blast chamber.

12. The blasting device as defined in claim 1 in which adjustment means are carried by the frame for adjusting the handle relative to the frame.

13. The blasting device, as defined in claim 12 in which the adjustment means includes a pair of channels; in which the handle is formed with a pair of downwardly extending end portions; in which each end portion is sized to be received within one channel whereby the handle may be positioned within one channel and extend over one end wall of the frame, and may be positioned within the other channel to extend over the other end wall of the frame.

14. A blasting device for directing air entrained blast media at a work surface, the blasting device comprising:

a frame having a pair of end walls;

a plurality of wheels supporting the frame defining a path of travel;

inlet means for receiving air entrained blast media;

a blast nozzle operatively connected with the inlet means and carried by the frame;

a handle attached to the frame;

a pair of channels;

a pair of downwardly extending end portions formed on the handle, each end portion being sized to be received within one channel whereby the handle may be positioned within one channel to extend over one end wall of the frame, and may be positioned within the other channel to extend over the other end wall of the frame;

spring biasing means extending between the handle and the frame for biasing each end portion of the handle into a channel whereby said spring biasing means must be overcome to move the handle from one adjacent end wall to adjacent the other end wall; and a mounting pin carried by the frame for slidably mounting each end portion of the handle thereto.

15. A blasting device for directing air entrained blast media at a work surface, the blasting device comprising:

a frame having a pair of end walls;

a plurality of wheels supporting the frame defining a path of travel;

inlet means for receiving air entrained blast media;

a blast nozzle operatively connected with the inlet means and carried by the frame;

a handle attached to the frame;

oscillating means for oscillating the blast nozzle;

an actuation lever carried by the handle;

a first switch means for actuating the oscillating means; and a second switch for allowing air within trained blast media to exit the blast nozzle whereby the actuation lever actuates the first switch means to actuate the oscillating means prior to actuating the second switch means thereby assuring that the oscillating means is in operation prior to blast media exiting the nozzle to contact the work surface.

* * * * *